US009276321B2

(12) United States Patent
Smith et al.

(10) Patent No.: US 9,276,321 B2
(45) Date of Patent: Mar. 1, 2016

(54) DIAGONALLY-DRIVEN ANTENNA SYSTEM AND METHOD

(75) Inventors: Hugh K. Smith, Palatine, IL (US); Eric L. Krenz, Crystal Lake, IL (US); Karan J. Jumani, Palatine, IL (US); Andrew A. Efanov, Crystal Lake, IL (US)

(73) Assignee: Google Technology Holdings LLC, Mountain View, CA (US)

( * ) Notice: Subject to any disclaimer, the term of this patent is extended or adjusted under 35 U.S.C. 154(b) by 475 days.

(21) Appl. No.: 13/615,807

(22) Filed: Sep. 14, 2012

(65) Prior Publication Data

US 2013/0009842 A1 Jan. 10, 2013

Related U.S. Application Data

(63) Continuation of application No. 13/107,560, filed on May 13, 2011.

(51) Int. Cl.

| | |
|---|---|
| ***H01Q 1/48*** | (2006.01) |
| ***H01Q 9/42*** | (2006.01) |
| ***H01Q 9/04*** | (2006.01) |
| ***H01Q 21/28*** | (2006.01) |

(52) U.S. Cl.

CPC ..... *H01Q 9/42* (2013.01); *H01Q 9/0421* (2013.01); *H01Q 21/28* (2013.01)

(58) Field of Classification Search

USPC ..... 343/850, 853, 855

See application file for complete search history.

(56) References Cited

U.S. PATENT DOCUMENTS

| | | | |
|---|---|---|---|
| 4,103,303 | A | 7/1978 | Regenos et al. |
| 4,293,955 | A | 10/1981 | Gehr et al. |
| 4,571,595 | A | 2/1986 | Phillips et al. |
| 4,575,725 | A | 3/1986 | Tresselt |
| 4,613,868 | A | 9/1986 | Weiss |

(Continued)

FOREIGN PATENT DOCUMENTS

| | | | |
|---|---|---|---|
| EP | 0749216 | A1 | 12/1996 |
| EP | 2221915 | A1 | 8/2010 |

(Continued)

OTHER PUBLICATIONS

Freescale Semiconductor, "Compact Integrated Antennas Designs and Applications for the MC1319x, MC1320x, and MC1321x", Document No. AN2731 Rev 1 4, Jul. 2006, 20 pages.

(Continued)

*Primary Examiner* — Matthew Mikels

(74) *Attorney, Agent, or Firm* — Faegre Baker Daniels LLP

(57) ABSTRACT

An electronic device (100) includes an antenna system (150) having two antennas (110, 120). A first antenna (110) has a first antenna element (111) positioned outside a first corner (191) of a planar, rectangular ground plane (165) and a second antenna element (115) positioned outside a second corner of the ground plane that is diagonally across from the first corner. A second antenna (120) has a third antenna element (121) positioned near a third corner (193) of the ground plane that is adjacent to the first corner and a fourth antenna element (125) positioned near a fourth corner (195) of the ground plane that is diagonally across from the third corner. At low-band frequencies, the antenna elements (111, 115) of the first antenna (110) are driven out-of-phase relative to each other. Similarly, at low-band frequencies, the antenna elements (121, 125) of the second antenna (120) are driven out-of-phase relative to each other.

15 Claims, 6 Drawing Sheets

(56) References Cited

U.S. PATENT DOCUMENTS

| | | | | |
|---|---|---|---|---|
| 5,038,151 | A | 8/1991 | Kaminski | |
| 5,138,328 | A | 8/1992 | Zibrik et al. | |
| 5,274,388 | A | 12/1993 | Ishizaki et al. | |
| 5,365,246 | A | 11/1994 | Rasinger et al. | |
| 5,463,406 | A | 10/1995 | Vannatta et al. | |
| 5,600,337 | A | 2/1997 | Cassel | |
| 5,606,733 | A | 2/1997 | Kanayama et al. | |
| 5,760,745 | A | 6/1998 | Endo et al. | |
| 5,977,916 | A | 11/1999 | Vannatta et al. | |
| 6,052,093 | A | 4/2000 | Yao et al. | |
| 6,175,334 | B1 | 1/2001 | Vannatta et al. | |
| 6,583,765 | B1 | 6/2003 | Schamberger et al. | |
| 7,129,907 | B2 | 10/2006 | Lin et al. | |
| 7,292,195 | B2 | 11/2007 | Phillips et al. | |
| 7,965,252 | B2 | 6/2011 | Shtrom et al. | |
| 8,055,216 | B2 | 11/2011 | Dent | |
| 8,369,390 | B2 | 2/2013 | Rofougaran | |
| 2002/0084943 | A1 | 7/2002 | Tsai et al. | |
| 2002/0089456 | A1 | 7/2002 | Hamada | |
| 2006/0097919 | A1 | 5/2006 | Puckey et al. | |
| 2006/0220959 | A1 | 10/2006 | Ying | |
| 2007/0123181 | A1 | 5/2007 | Bit-Babik et al. | |
| 2008/0048867 | A1 * | 2/2008 | Oliver et al. | 340/572.7 |
| 2009/0128425 | A1 | 5/2009 | Kim et al. | |
| 2010/0045553 | A1 * | 2/2010 | Ohira et al. | 343/749 |
| 2012/0287011 | A1 * | 11/2012 | Smith et al. | 343/853 |

FOREIGN PATENT DOCUMENTS

| | | | |
|---|---|---|---|
| JP | 61-44919 | U | 3/1986 |
| JP | 06-120729 | A | 4/1994 |
| JP | 08-023224 | A | 1/1996 |
| WO | 2011084715 | A1 | 7/2011 |
| WO | 2012003061 | A1 | 1/2012 |
| WO | 2012008705 | A2 | 1/2012 |

OTHER PUBLICATIONS

Patent Cooperation Treaty, "PCT Search Report and Written Opinion of the International Searching Authority" for International Application No. PCT/US2012/035093, Jul. 16, 2012, 12 pages.

United States Patent and Trademark Office, "Non-Final Rejection" for U.S. Appl. No. 13/107,560, Jun. 18, 2013, 7 pages.

United States Patent and Trademark Office, "Final Rejection" for U.S. Appl. No. 13/107,560, Oct. 7, 2013, 8 pages.

Patent Cooperation Treaty, "PCT Search Report and Written Opinion of the International Searching Authority" for Int'l Pat. Appln. No. PCT/US2014/010180, Mar. 21, 2014, 9 pages.

United States Patent and Trademark Office, "Non-Final Rejection" for U.S. Appl. No. 13/737,971, Apr. 10, 2014, 10 pages.

* cited by examiner

DIAGONALLY-DRIVEN ANTENNA SYSTEM AND METHOD

CROSS REFERENCE TO RELATED APPLICATIONS

This application is related to U.S. patent application Ser. No. 13/107,560 (CS38569) entitled "Diagonally-Driven Antenna System and Method" by Hugh K. Smith et al. and filed on May 13, 2011. This related application is assigned to the assignee of the present application and is hereby incorporated herein in its entirety by this reference thereto.

FIELD OF THE DISCLOSURE

This disclosure relates generally to antenna systems, and more particularly to antenna systems with two antennas that are in close proximity to each other.

BACKGROUND OF THE DISCLOSURE

Wireless communication devices such as radiotelephones sometimes use two antenna systems with two or more antennas to transmit and receive radio frequency signals. In a radiotelephone using two diversity antennas, the second antenna should have comparable performance with respect to the first antenna, and the second antenna should also have sufficient de-correlation with respect to the first antenna so that performance improvements offered by diversity operation in multi-path propagation environments can be realized.

Diversity antenna system performance is a combination of many parameters. Sufficient operating frequency bandwidth (s), high radiation efficiency, desirable radiation pattern characteristic(s), and low correlation between diversity antennas are all desired components of diversity antenna system performance. Correlation is computed as the normalized covariance of the radiation patterns of two antennas. Due to the dimensions and generally-accepted placement of a main antenna along a major axis or a minor axis of a device such as a hand-held radiotelephone, however, efficiency and de-correlation goals are extremely difficult to achieve simultaneously.

Thus, there is an opportunity to continue to develop antenna structures that have broad operating frequency bandwidth(s), good radiation efficiency, and/or low-correlation radiation patterns. The various aspects, features, and advantages of the disclosure will become more fully apparent to those having ordinary skill in the art upon careful consideration of the following Drawings and accompanying Detailed Description.

Figure 1:
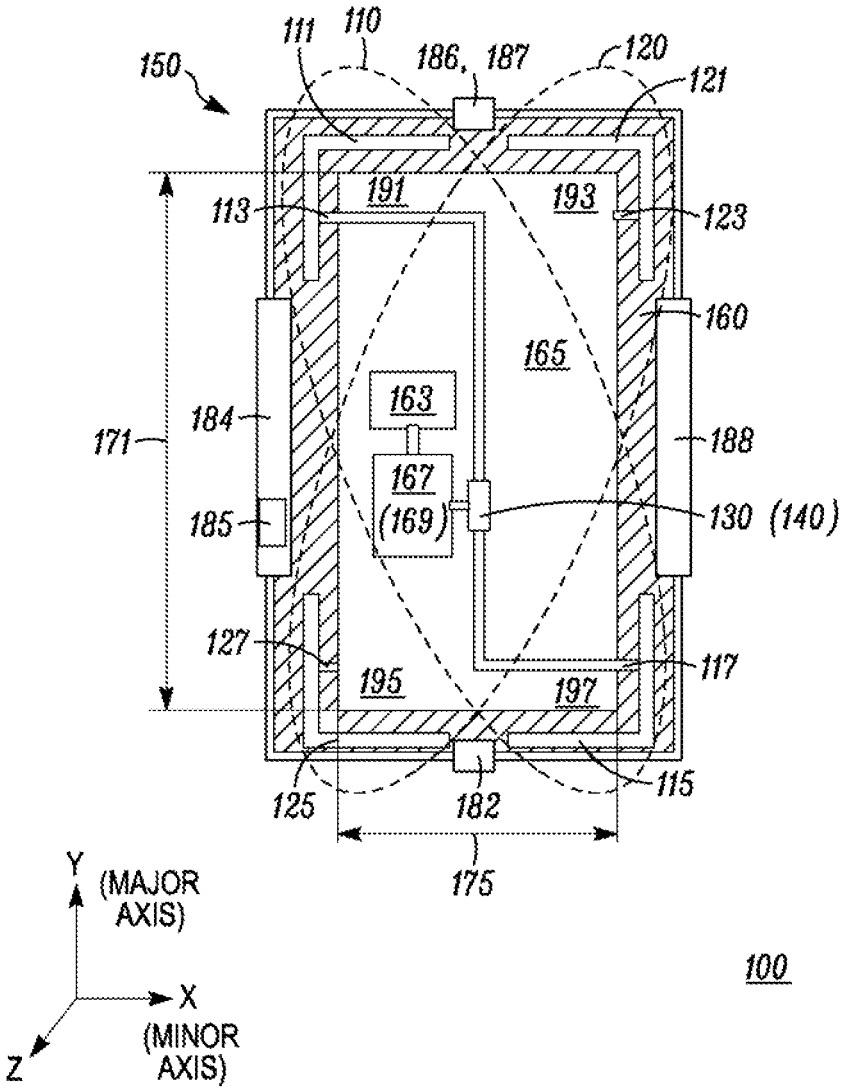
FIG. 1 shows a simplified diagram of a diagonally-driven antenna system implemented according to a first embodiment in an electronic device such as a radiotelephone.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The apparatus and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

DETAILED DESCRIPTION

Diversity antenna systems are useful in wireless communication devices. There are difficulties, however, in implementing diversity antenna systems in small wireless communication devices, because the half-wavelengths of operation are sometimes larger than the major dimension of the entire device housing. Additionally, many wireless communication devices now operate in multiple frequency bands ranging from 700 MHz to 5 GHz.

An electronic device includes an antenna system having two antennas oriented in a saltire or "X" configuration across a ground plane. A first antenna has a first antenna element positioned near a first corner of a planar, rectangular ground plane and a second antenna element positioned near a second corner of the ground plane that is diagonally across from the first corner. A second antenna has a third antenna element positioned near a third corner of the ground plane that is adjacent to the first corner and a fourth antenna element positioned near a fourth corner of the ground plane that is diagonally across from the third corner. This antenna system may be useful for diversity and also useful for non-diversity applications such as when two transmitters are operating without diversity.

At low-band frequencies, the antenna elements of the first antenna are driven out-of-phase relative to each other. Similarly, at low-band frequencies, the antenna elements of the second antenna are driven out-of-phase relative to each other. At high-band frequencies, the antenna elements of the first antenna may be driven either out-of-phase or in-phase relative to each other. Similarly, at high-band frequencies, the antenna elements of the second antenna may be driven either out-of-phase or in-phase relative to each other. By the principle of reciprocity, antennas used for transmission may also be used for reception. Throughout this document, concepts using transmission terminology may be replaced with the reciprocal concepts of reception. These antenna structures and antenna driving methodologies promote a broad operating frequency bandwidth for each antenna, high radiation efficiency, desirable radiation pattern characteristics, and low correlation between the two constituent antennas.

FIG. 1 shows a simplified diagram of a diagonally-driven antenna system 150 implemented according to a first embodiment in an electronic device 100 such as a radiotelephone or other wireless communication device. Although a radiotelephone is presumed, the electronic device could be a tablet computer, a laptop computer, a personal digital assistant, a gaming console, a remote controller, an electronic book reader, or many alternate devices with wireless communication capabilities. The electronic device 100 includes a planar, rectangular circuit board 160 with a planar, rectangular conductive ground plane 165 in one of the layers in the circuit board. For the sake of simplicity, the circuit board 160 and ground plane 165 are modeled and described as being planar rectangles. Depending on the device implementation, though, the circuit board and/or ground plane may have a slight curvature. Also, the perimeter(s) of the circuit board and/or ground plane may only be generally rectangular; the perimeter may have protrusions or indentations that depart from a geometric rectangle. Note that, in the implementation shown, the ground plane 165 does not extend to the edges of the circuit board 160. This allows the circuit board 160 to support four antenna elements 111, 115, 121, 125 at the corners of the circuit board 160 and near the corners 191, 193, 195, 197 of the ground plane 165.

One benefit of placing antenna elements 111, 115, 121, 125 at corners of a rectangular circuit board 160 is that external connector ports for the electronic device can be placed near the midpoints of the perimeter sides of the circuit board 160. FIG. 1 shows several potential external connector port locations 182, 184, 186, 188 outside of the "keep out" areas around each antenna element 111, 115, 121, 125. These connector ports may couple data and/or power to and from accessories such as an audio headset, a charger, a docking station with connectors to peripherals such as keyboards, displays, and mouse-type controllers, and many others. Thus, if the electronic device were implemented as a tablet computer with wireless communication capabilities, one external connector port 187 could be implemented as an analog audio headset jack at location 186 along a minor length of the electronic device 100, and another external connector port 185 could be positioned at location 184 near a midpoint of a major length of the electronic device 100 and implemented as a connector to a desktop, vehicle, or other type of docking station. These locations are outside of the "keep out" areas of the antenna elements, therefore minimizing the effect of the power and data signaling on the antenna system.

In this first embodiment, each of the four antenna elements 111, 115, 121, 125 is modeled as an L-shaped antenna element positioned with its interior angle around a different corner 191, 193, 195, 197 of the planar, rectangular ground plane 165. Each antenna element 111, 115, 121, 125 has a driving point 113, 117, 123, 127 (sometimes called a "feed port" or "feed location") along one arm. A first diagonally-positioned pair of antenna elements 111, 115 is driven through their driving points 113, 117 of the L-shaped radiators 111, 115 and creates a first antenna 110 of the antenna system 150. A second diagonally-positioned pair of antenna elements 121, 125 is driven through their driving points 123, 127 and creates a second antenna 120 of the antenna system 150. In this manner, the diagonally-driven antenna system 150 includes two antennas 110, 120 that are diagonally oriented relative to the rectangular ground plane 165.

Each antenna 110, 120 is designed to support at least one frequency band of operation. Any antenna, however, can be designed to support more than one frequency band of operation. Also, the individual antennas 110, 120 may support overlapping bands of operation or non-overlapping bands of operation. For example, one antenna may support low-band (e.g., 800-900 MHz) operation and high-band (e.g., 1800-1900 MHz) operation while another antenna may support low-band (e.g., 800-900 MHz) operation, high-band GPS reception (e.g., 1.5 GHz), and high-band WLAN operation (e.g., 2.4-2.5 GHz). In this example, the antenna system should exhibit good de-correlation at the overlapping bands of operation (e.g., 800-900 MHz).

Thus, the two antennas 110, 120 form an antenna system 150 having a saltire or "X" design. Note that, based on the configuration of the ground plane, the two arms of the saltire may not meet at right angles (or, alternately, may meet at right angles). The diagonal orientation of the two antennas 110, 120 provide for significant length-mode dipole excitation along the major axis (y-axis) of the ground plane 165 and for non-negligible width-mode dipole excitation along the minor axis (x-axis) of the ground plane by both antennas 110, 120. (Alternately, a slightly different implementation would provide for significant width-mode dipole excitation along the minor axis and non-negligible length-mode excitation along the major axis.) This is fundamentally different from antennas that are positioned orthogonally relative to a rectangular ground plane (i.e., a cross or "+" or "T" or "L" configuration), where each antenna creates significant excitation along one axis of a ground plane and negligible excitation along the orthogonal axis of the ground plane. Because both antennas 110, 120 in the antenna system 150 partially excite the major axis, both antennas 110, 120 may realize a broad bandwidth and high efficiency. Also, because the antennas 110, 120 are generally symmetrical, the antenna system 150 may achieve near-equal gain with low correlation at low bands as well as high bands.

Operation of either antenna 110, 120 of the antenna system 150 at a frequency with a wavelength that is approximately twice the major length 171 of the ground plane 165 is considered low-band operation. The major length 171 is only an approximate indicator of low-frequency band wavelength because conductive elements coupled (e.g., capacitively, inductively, or directly) to the ground plane may cause the electrical length of the ground plane to differ from the geometric major length 171 of the ground plane. In this example, the major length 171 of the ground plane 165 is along the y axis shown. During low-band operation, the antenna elements of a single antenna of the antenna system 150 may be driven out-of-phase and at the same magnitude. A first phase shifter 130, such as a balun or transmission line, can be used to create the drive signals for each radiator 111, 115 of the first antenna 110. Similarly, a second phase shifter 140 can be used to create the drive signals for each radiator 121, 125 of the second antenna 120 during low-band operation. In order to de-clutter the drawing, the second phase shifter 140 and the second set of signal lines to the driving points 123, 127 of the radiating elements 121, 125 of the second antenna 120 are positioned on the back side of the printed circuit board 160 and shown in dashed lines. Of course, the second phase shifter 140 and the second set of signal lines may be implemented on the front side of the printed circuit board along with the first phase shifter 130 and the first set of signal lines.

Operation of either antenna 110, 120 of the antenna system 150 at high bands occurs when the wavelengths of transmission (or reception) are less than twice the major length 171 of the ground plane 165. During high-band transmission, the diagonally-positioned elements of each antenna of the antenna system 150 may be driven either in-phase or out-of-phase.

Transmission signals to the first antenna 110 and reception signals from the first antenna may be coupled via signal lines to a first transceiver 167 of the electronic device 100. Similarly, transmission signals to the second antenna 120 and reception signals from the second antenna may be coupled via signal lines to a second transceiver 169 of the electronic device 100. The signal lines may be implemented as any transmission lines well-known in the art such as striplines or coaxial transmission lines. (Note that, in this implementation, the second transceiver 169 is on the back side of the printed circuit board 160.) The transceivers 167, 169 may be controlled by a controller 163. The controller may also control various other elements of the electronic device such as user input components (e.g., a keypad, touchpad, accelerometer, or microphone) (not shown), user output components (e.g., a display, loudspeaker, or haptic element) (not shown), and external connector ports to other devices.

Figure 2:
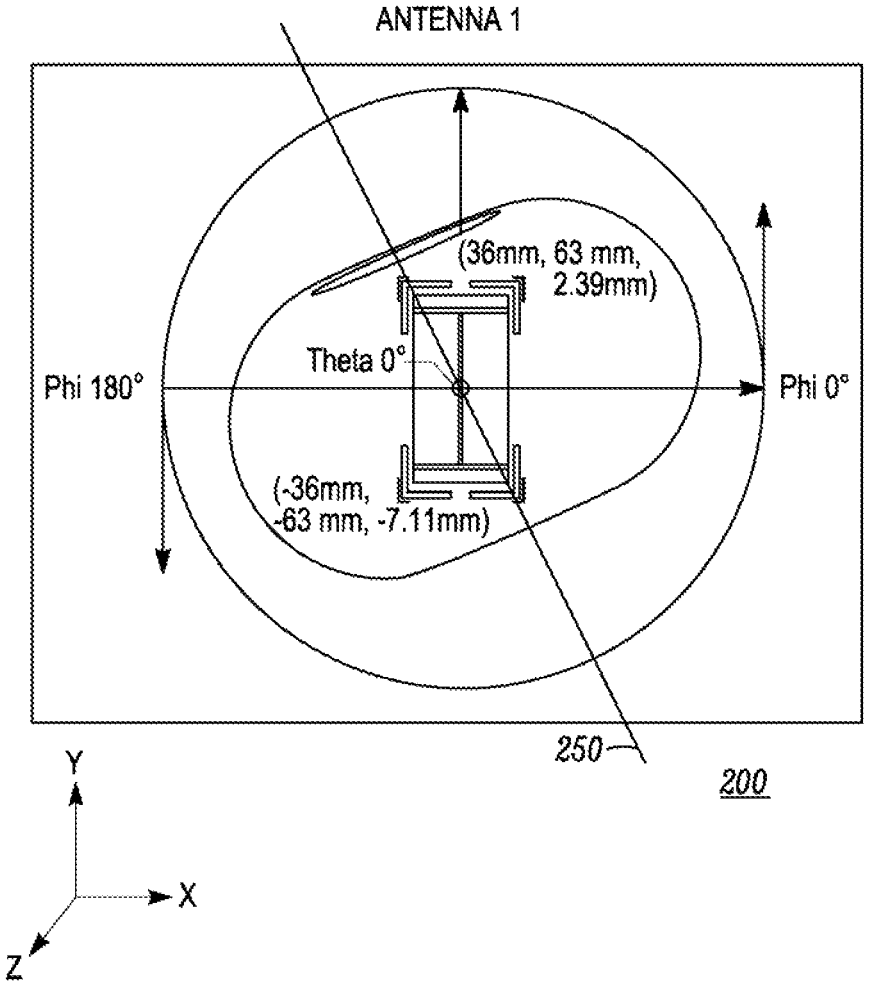
FIG. 2 shows a low frequency band far-field radiation pattern for a first diagonally-driven antenna of an antenna system according to the first embodiment.

FIG. 2 shows a low frequency band far-field radiation pattern 200 for a first diagonally-driven antenna 110 of an antenna system 150 according to the first embodiment. The axes of the radiation pattern are aligned according to the axes shown in FIG. 1. As mentioned earlier, transmitting (or receiving) signal wavelengths that are approximately twice the major length 171 of the ground plane 165 is considered low-band operation. At low-band operation of the first diagonally-driven antenna 110 of the antenna system 150 shown in FIG. 1, the signals to each antenna element 111, 115 are out-of-phase, and the far-field radiation pattern 200 generally has the shape of a toroid with an axis of rotation 250 along the diagonal of the first diagonally-driven antenna 110.

Figure 3:
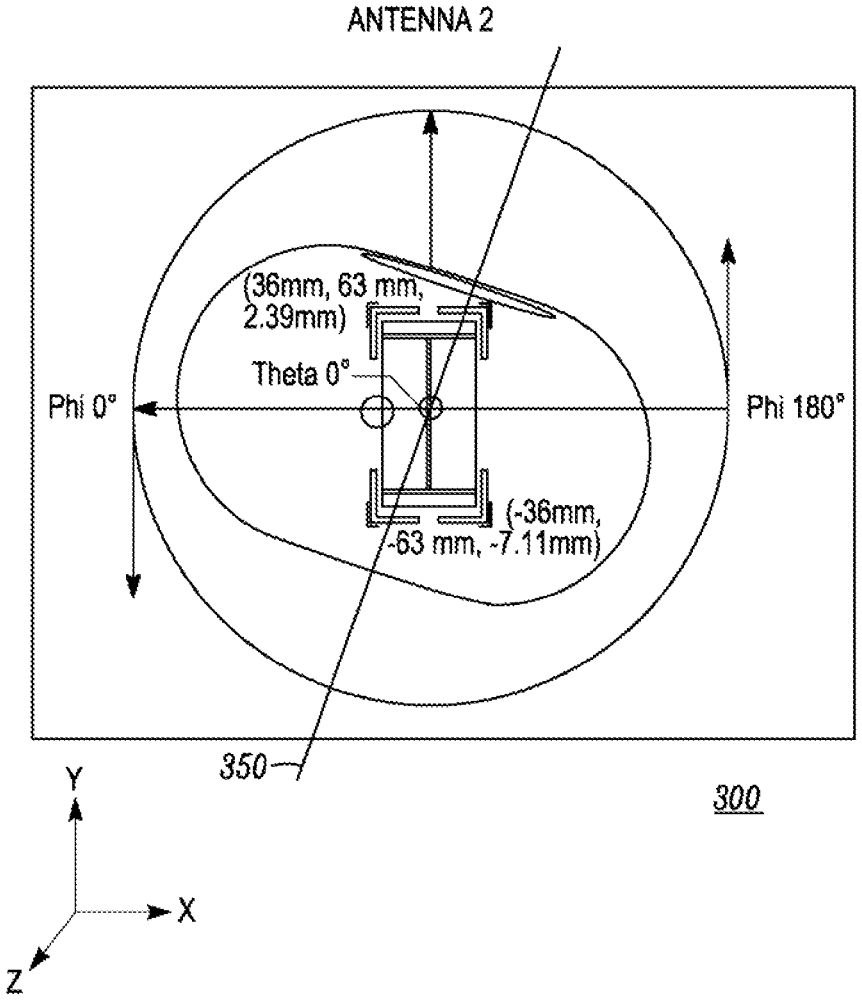
FIG. 3 shows a low frequency band far-field radiation pattern for a second diagonally-driven antenna of an antenna system according to the first embodiment.

Similarly, FIG. 3 shows a low frequency band far-field radiation pattern 300 for the second diagonally-driven antenna 120 of the antenna system 150 according to the first embodiment. Again, the axes of the radiation pattern are aligned according to the axes shown in FIG. 1. At low-band operation of the second diagonally-driven antenna 120 of the antenna system 150 shown in FIG. 1, the signals to each antenna element 121, 125 are out-of-phase relative to each other. Note that this far-field radiation pattern 300 also generally has the shape of a toroid but with an axis of rotation 350 along the diagonal of the second diagonally-driven antenna 120.

The relative tilt between the far-field radiation patterns 200, 300 for each antenna 110, 120 provides de-correlation between antennas, which is essential for diversity reception or transmission using multiple-input multiple-output (MIMO) systems and also useful for may other transmission schemes that use multiple antennas to combat or exploit multi-path propagation effects, as are well-known in the art. Based on the phase difference of the driving signals to each pair of diagonally-positioned elements in the diagonally-driven antenna system 150, the relative tilt between the radiation patterns 200, 300 can be adjusted to improve bandwidth and efficiency while maintaining de-correlation. Thus, each pair of antenna elements may be strictly differentially driven (e.g., 180±10 degrees out-of-phase relative to each other), moderately differentially driven (e.g., 180±50 degrees out-of-phase relative to each other), or loosely differentially driven (e.g., 180±90 degrees out-of-phase relative to each other). The signal transmission line lengths and impedances, antenna feed structures, and individual antenna element designs can be adjusted depending on the frequency bands of interest, the size and shape of the ground plane 165, the size and shape of the overall electronic device 100, and the intended usage of the electronic device (e.g., hand-held or stand-alone) with the goal of achieving a desired level of de-correlation of the far-field radiation patterns 200, 300 at designated operational frequency bands, including low frequency bands, while realizing acceptable efficiency and bandwidth for each antenna.

Although FIG. 1 shows similar, symmetrical L-shaped antenna elements 111, 115, 121, 125 positioned around each corner 191, 193, 195, 197 of a rectangular ground plane 165, the antenna elements may be implemented as different types of antenna elements including L-shaped, inverted F-shaped antenna (IFA), planar inverted F-shaped antenna (PIFA), monopole, folded inverted conformal antenna (FICA), and patch. For example, a first diagonally-positioned antenna may have one L-shaped antenna element and one inverted F-shaped antenna (IFA) element. Meanwhile, a second diagonally-positioned antenna may have one planar inverted F-shaped antenna (PIFA) element and one monopole antenna element. Many options are available, depending on the operational frequencies of the electronic device, its size and shape, and the various antenna system performance targets. Note that, in some implementations, an antenna element may partially or fully overlap with the ground plane (as opposed to the examples shown in where no antenna element overlaps the ground plane).

Figure 4:
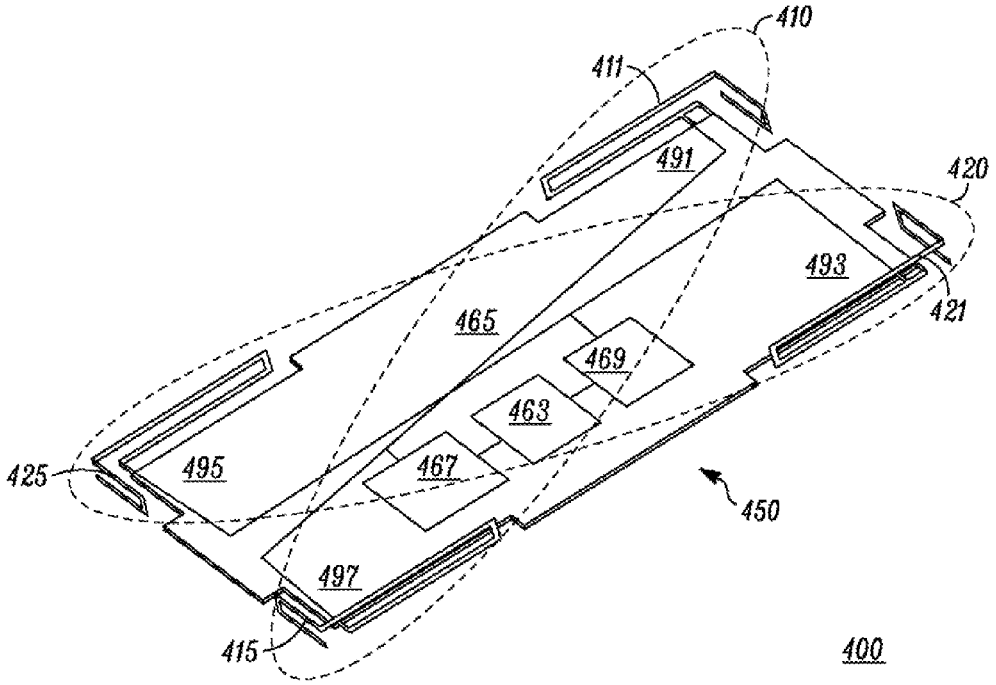
FIG. 4 shows a simplified perspective diagram of a diagonally-driven antenna system implemented according to a second embodiment in an electronic device such as a radiotelephone.
Figure 5:
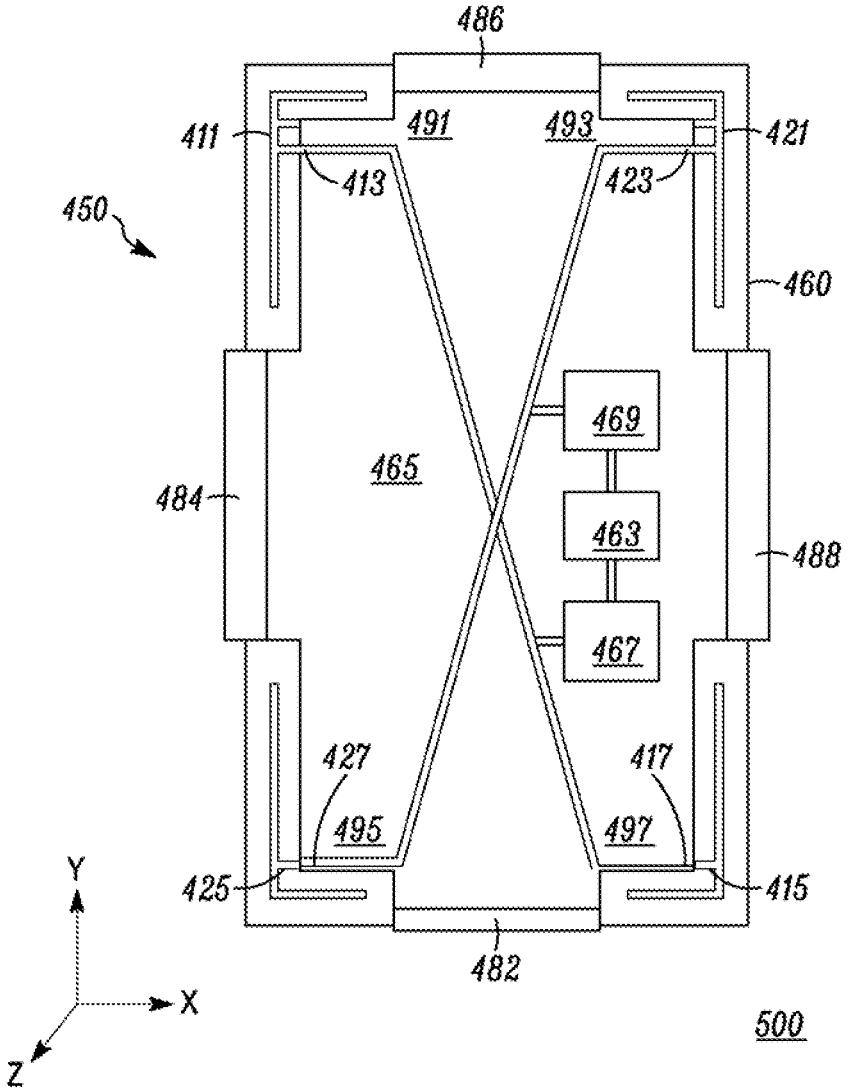
FIG. 5 shows a simplified plan diagram of the diagonally-driven antenna system of FIG. 4.

FIG. 4 shows a simplified perspective diagram of a diagonally-driven antenna system 450 implemented according to a second embodiment that can be used by an electronic device 400 such as a radiotelephone or other wireless communication device. FIG. 5 shows a simplified plan diagram 500 of the diagonally-driven antenna system of FIG. 4.

As shown in FIGS. 4-5, the antenna system 450 includes a planar, rectangular ground plane 465 with an antenna element 411, 415, 421, 425 at each of the four corners 491, 493, 495, 497 of the ground plane 465. As can be seen in FIGS. 4-5, a first antenna element 411 is an IFA structure with feed port 413 and a tail wrapped around itself on the edges in order to obtain the required length of operation at a low band frequency. Of course, other techniques may be used to obtain the proper frequency of operation. In this implementation, the low band frequency is around 900 MHz for radiotelephone operation. A diagonally-positioned second antenna element 415, which is paired with the first antenna element 411 to create a first antenna 410, is an L-shaped antenna element with a feed port 417 which is variant of a monopole antenna structure folded around itself on the edges to obtain the required length of operation at the 900 MHz low frequency band of operation. As mentioned earlier, other techniques may be used to obtain the proper frequency of operation.

The second antenna 420 includes a third antenna element 421, which is an IFA element and feed port 423 similar to the first antenna element 411 (but in a mirrored configuration), and a fourth antenna element 425, which is a L-shaped antenna element and feed port 427 similar to the second antenna element 415 (but in a mirrored configuration). As shown in this second implementation, two transceivers 467, 469 and two sets of signal lines are shown on the same side of the ground plane 165. Note that, in this implementation, the two sets of signal lines do not electrically couple but instead take advantage of a multi-layer printed circuit board structure so that one of the sets of signal lines passes under the other set of signal lines. The signals lines can be implemented as coaxial transmission lines, striplines, or other transmission lines well known in the art.

A first transceiver 467 may be coupled to the first antenna 410 and drive the antenna elements either differentially or commonly as directed by a controller 463. As mentioned previously, depending on the desired radiation patterns and target efficiencies and bandwidth of each antenna, the pair of antenna elements 411, 415 may be strictly differentially driven, moderately differentially driven, or loosely differentially driven. A second transceiver 469 may be coupled to the second antenna 420 and drive the antenna elements either differentially or commonly as directed by the controller 463.

When a transmission signal to the first antenna 410 is in a low frequency band, the constituent antenna elements 411, 415 are driven out-of-phase relative to each other. Similarly, when a transmission signal to the second antenna 420 is in a low frequency band, the constituent antenna elements 421, 425 are driven out-of-phase relative to each other. In this implementation, phase shift is achieved through the signal transmission lines and the different antenna elements. Thus, no separate phase shifter element is needed in some implementations.

Low band operation occurs when the transmission signal has a wavelength that is approximately twice the major electrical length of the ground plane 465. Note that, although the major electrical length is usually close to the major geometric length of the ground plane, conductive elements coupled (e.g., capacitively, inductively, or directly) to the ground plane may affect the electrical length of the ground plane.

At high band operation, the antenna elements 411, 415 of the first antenna 410 may be driven either differentially or commonly (e.g., in phase) relative to each other. Similarly, the antenna elements 421, 425 of the second antenna 420 may be driven either differentially or commonly during high band operation.

FIG. 5 shows a range of four potential external connector port locations 482, 484, 486, 488 all of which are outside the "keep out" areas of the antenna elements 411, 415, 421, 425. Depending on the size of the external connectors, one or more external connector ports may be implemented in any of the locations. Note that, although the available connector port locations are generally near a midpoint of a perimeter side of the electronic device 500, any single external connector port does not need to be located at the midpoint of the electronic device or at a midpoint of the printed circuit board 160 or ground plane 465.

Figure 6:
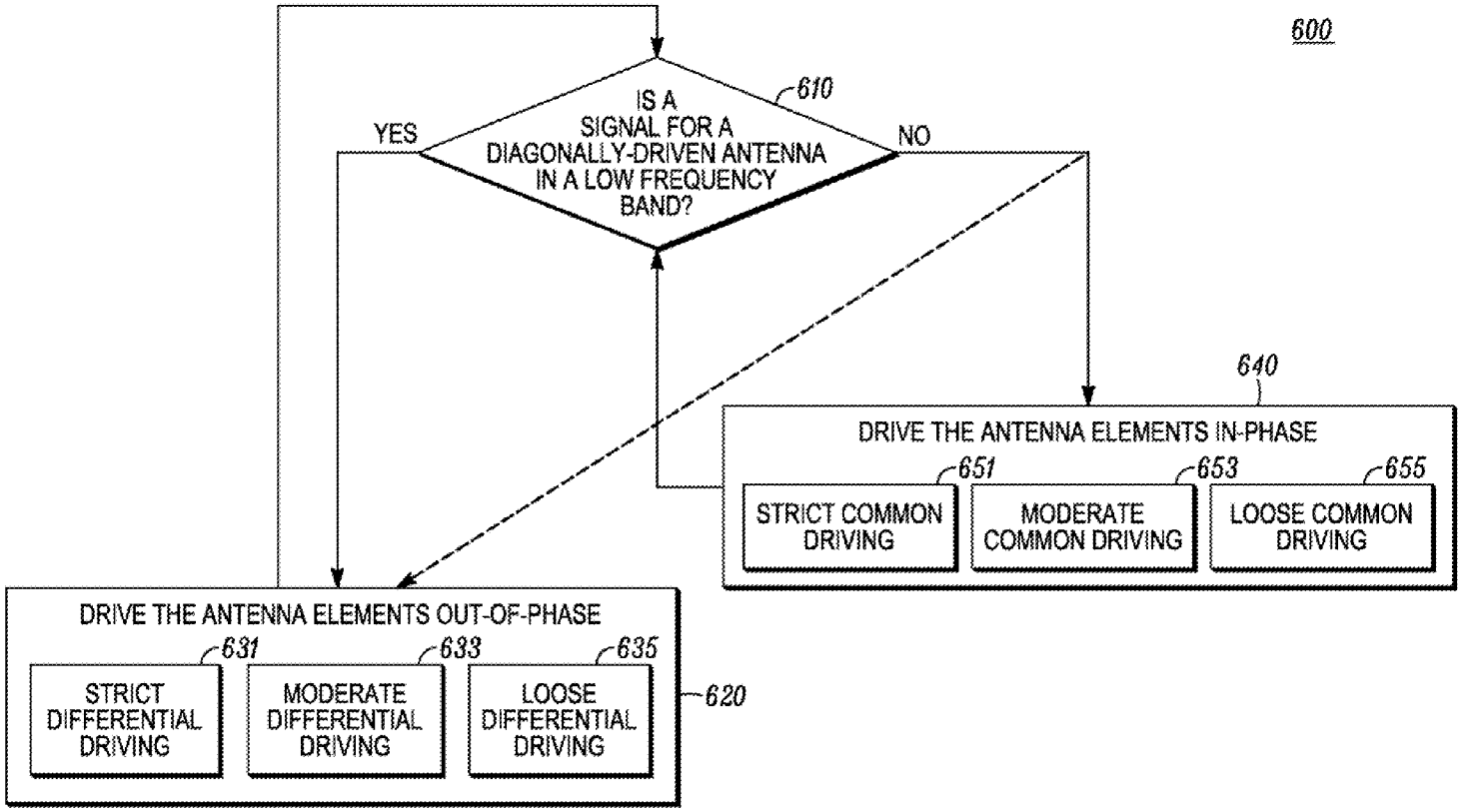
FIG. 6 shows a flowchart of a method for driving an antenna structure that may be used in conjunction with the diagonally-driven antenna systems shown in FIGS. 1-5.

FIG. 6 shows a flow diagram 600 of a method for driving an antenna structure that may be used in conjunction with the diagonally-driven antenna systems of the electronic devices shown in FIGS. 1-5. Each antenna in a diagonally-driven antenna system may be used as a transmit antenna (or a receive antenna) independently of the other antenna. When one of the antennas is used as a transmit antenna, a circuit of the electronic device determines 610 any low frequency band components of the driving signal. (Note that the driving signal may include both low-band components and high-band components.) The circuit may be implemented as a passive multi-band circuit or as an active controller. If the signal is in a low frequency band, the transmitter, optionally in conjunction with a phase shifter, drives 620 the two constituent antenna elements of the diagonally-driven antenna out-of-phase, and optionally at the same magnitude, relative to each other. There are various levels of out-of-phase driving that can be implemented based on the use cases and configurations for the antenna system, such as strict differential driving 631, moderate differential driving 633, and loose differential driving 635. Because evaluation of the driving signal may be continuous, the flow diagram 600 shows the flow returning to step 610.

Meanwhile, if the signal to-be-transmitted is in a frequency band that is higher than the low frequency band, the transmitter drives 640 the constituent antenna elements of the diagonally-driven antenna in-phase, and optionally at the same magnitude, relative to each other. As with the out-of-phase driving situation, there are various levels of in-phase driving that can be implemented based on the use cases and configurations for the antenna system, such as strict common driving (e.g., 0±10 degrees) 651, moderate common driving (e.g., 0±50 degrees) 653, and loose common driving (e.g., 0±90 degrees) 655. If a passive multi-band circuit is used, the circuit would provide differential feeding at low band and common-mode feeding at high band, possibly simultaneously and without any active switching between these two states. Alternately, the transmitter may drive 620 the antenna elements out-of-phase relative to each other. Because high-band radiation patterns are naturally more de-correlated than low-band radiation patterns (for a similarly-sized portable communication device), the phase difference between the feed signals of the two antenna elements of a diagonally-driven antenna is not as critical for de-correlation. After the high-band signal is transmitted, the flow may return to step 610 for continuous evaluation of the driving signal. This flow diagram 600 may be independently implemented for each antenna in a diagonally-driven antenna system.

Thus, the diagonally-driven antenna system and method promotes broad operating frequency bandwidth(s), high radiation efficiency, desirable radiation pattern characteristics, and low correlation between collocated antennas. While high-band antenna signals are naturally de-correlated, low-band antenna signals are differentially fed to assist in de-correlation between the antennas of the antenna system.

While this disclosure includes what are considered presently to be the embodiments and best modes of the invention described in a manner that establishes possession thereof by the inventors and that enables those of ordinary skill in the art to make and use the invention, it will be understood and appreciated that there are many equivalents to the embodiments disclosed herein and that modifications and variations may be made without departing from the scope and spirit of the invention, which are to be limited not by the embodiments but by the appended claims, including any amendments made during the pendency of this application and all equivalents of those claims as issued. Accordingly, the specification and figures are to be regarded in an illustrative rather than a restrictive sense, and all such modifications are intended to be included within the scope of present teachings.

It is further understood that the use of relational terms such as first and second, top and bottom, and the like, if any, are used solely to distinguish one from another entity, item, or action without necessarily requiring or implying any actual such relationship or order between such entities, items or actions. Some of the inventive functionality and some of the inventive principles are best implemented with or in software programs or instructions. It is expected that one of ordinary skill, notwithstanding possibly significant effort and many design choices motivated by, for example, available time, current technology, and economic considerations, when guided by the concepts and principles disclosed herein will be readily capable of generating such software instructions and programs with minimal experimentation. Therefore, further discussion of such software, if any, will be limited in the interest of brevity and minimization of any risk of obscuring the principles and concepts according to the present invention.

As understood by those in the art, controller 163, 463 includes a processor that executes computer program code to implement the methods described herein. Embodiments include computer program code containing instructions embodied in tangible media, such as floppy diskettes, CD-ROMs, hard drives, or any other computer-readable storage medium, wherein, when the computer program code is loaded into and executed by a processor, the processor becomes an apparatus for practicing the invention. Embodiments include computer program code, for example, whether stored in a storage medium, loaded into and/or executed by a computer, or transmitted over some transmission medium, such as over electrical wiring or cabling, through fiber optics, or via electromagnetic radiation, wherein, when the computer program code is loaded into and executed by a computer, the computer becomes an apparatus for practicing the invention. When implemented on a general-purpose microprocessor, the computer program code segments configure the microprocessor to create specific logic circuits.

We claim:

1. An electronic device comprising:

a planar, rectangular ground plane with a first corner, a second corner diagonal from the first corner, a third corner adjacent to the first corner, and a fourth corner diagonal from the third corner;

a first antenna having a first antenna element positioned near the first corner and a second antenna element positioned near the second corner, wherein the first antenna element and the second antenna element do not overlap the planar, rectangular ground plane;

a second antenna having a third antenna element positioned near the third corner and a fourth antenna element positioned near the fourth corner; and a first phase shifter for differentially driving the first antenna element out of phase relative to the second antenna element.

2. An electronic device according to claim 1 wherein the third antenna element and the fourth antenna element do not overlap the planar, rectangular ground plane.

3. An electronic device according to claim 1 further comprising:

a transmitter, coupled to the first antenna, wherein the planar, rectangular ground plane has a major electrical length and wherein the phase shifter differentially drives the first antenna element out of phase relative to the second antenna element when a transmission wavelength is approximately twice the major electrical length.

4. An electronic device according to claim 1 further comprising:

a first receiver, coupled to the first antenna.

5. An electronic device according to claim 4 further comprising:

a second receiver coupled to the second antenna.

6. An electronic device according to claim 1 further comprising:

a transmitter coupled to the second antenna.

7. An electronic device according to claim 1 wherein the second antenna element comprises:

an inverted F-shaped antenna structure.

8. An electronic device according to claim 1 wherein the first antenna element comprises:

a planar inverted F-shaped antenna structure.

9. An electronic device according to claim 1 wherein the first phase shifter comprises:

a first balun.

10. An electronic device according to claim 1 wherein the first phase shifter comprises:

a first transmission line.

11. An electronic device according to claim 1 further comprising:

a second phase shifter for differentially driving the third antenna element out of phase relative to the fourth antenna element.

12. An electronic device according to claim 11 wherein the second phase shifter comprises:

a second balun.

13. An electronic device according to claim 11 wherein the second phase shifter comprises:

a second transmission line.

14. An electronic device according to claim 1 wherein the first antenna element and the second antenna element are located laterally outside a perimeter of the planar, rectangular ground plane.

15. An electronic device according to claim 2 wherein the third antenna element and the fourth antenna element are located laterally outside a perimeter of the planar, rectangular ground plane.

* * * * *